United States Patent [19]

Parker

[11] 4,121,337

[45] Oct. 24, 1978

[54] CEILING PATCH APPARATUS AND METHOD

[75] Inventor: Robert W. Parker, Santa Ana, Calif.

[73] Assignee: Anthony Franklin, Santa Ana, Calif:

[21] Appl. No.: 759,857

[22] Filed: Jan. 17, 1977

[51] Int. Cl.[2] ..... B26B 3/08; A47L 13/08

[52] U.S. Cl. ..... 30/172; 30/303

[58] Field of Search ..... 30/136, 301, 302, 172, 30/303; 408/224, 225; 145/114, 124, 116 R

[56] References Cited

U.S. PATENT DOCUMENTS

| | | | |
|---|---|---|---|
| 564,489 | 7/1896 | Weidner | 30/303 X |
| 2,683,312 | 7/1954 | Dover | 30/302 |
| 2,943,654 | 7/1960 | Labbee | 408/224 |
| 2,962,066 | 11/1960 | Deliso | 408/224 X |
| 3,289,297 | 12/1966 | Casselman | 30/172 X |
| 3,566,430 | 3/1971 | Young | 30/172 |
| 3,633,565 | 1/1972 | McDonald | 145/116 R |

*Primary Examiner*—Jimmy C. Peters
*Attorney, Agent, or Firm*—Jackson & Jones Law Corporation

[57] ABSTRACT

The problem of defaced acoustical ceilings in homes, apartments, offices, etc., is eliminated in a highly simple and economical manner. The ceilings are defaced as the result of the removal of decorative hooks which suspend plants, etc. In accordance with the present method, the unsightly hole and surrounding defaced region are effectively obscured by first removing a circular region of acoustical substance from the underlying wallboard surface, the circular region having as its center the hole formed by the decorative hook. Thereafter, a circular patch of acoustical material is applied to the wallboard surface, completely filling the circular region from which the acoustical material was removed. The result is such that it is difficult to ascertain what part is patched and what part is not.

In accordance with the apparatus, a circular patch of acoustical material (or simulated acoustical material) is provided in combination with a tool of corresponding size. The tool has a central portion which fits into the hole in the ceiling, and blade portions which scrape from the wallboard surface the acoustical material at a precisely defined region corresponding in size to the patch. Thereafter, the patch is inserted and adhesively secured to the wallboard surface. The resulting combination is an acoustical ceiling comprising wallboard, acoustical material applied thereto, a hole therein, and an acoustical patch secured in a scraped-off region of the acoustical ceiling material and centered at the hole.

7 Claims, 6 Drawing Figures

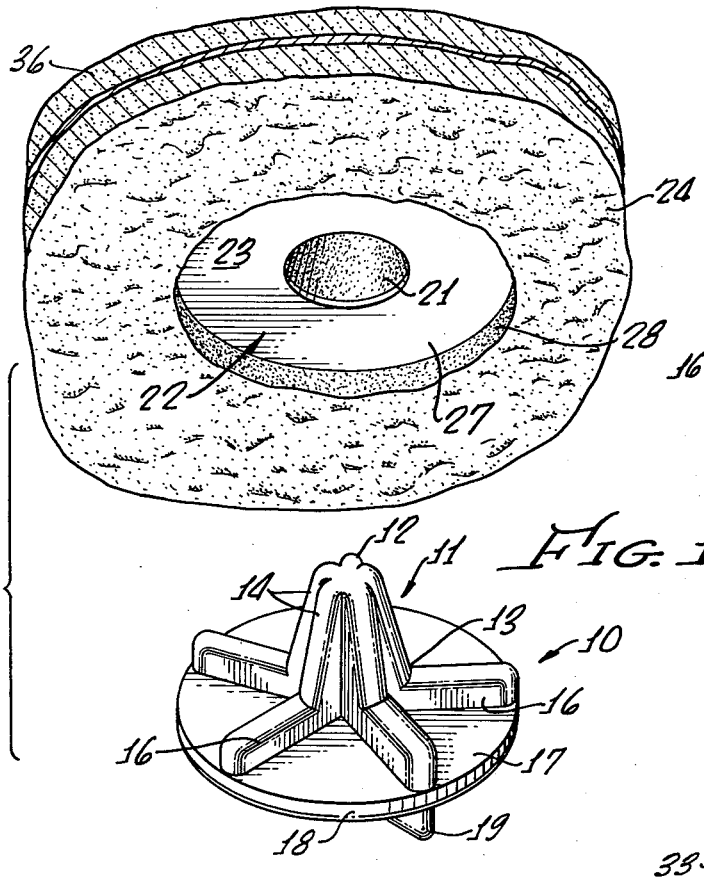
FIG. 1.
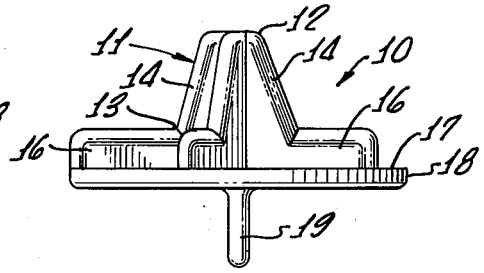
FIG. 2.
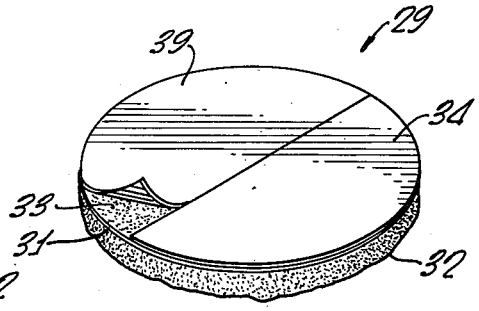
FIG. 3.
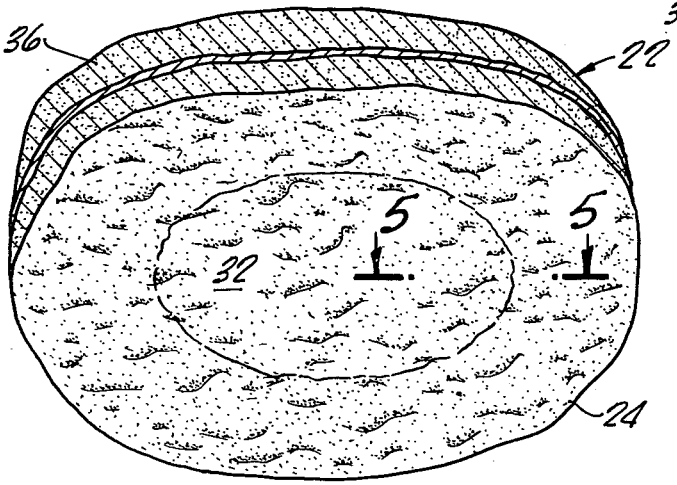
FIG. 4.
FIG. 6.
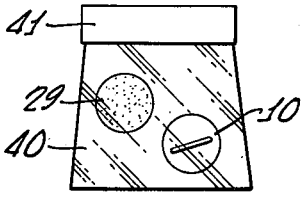
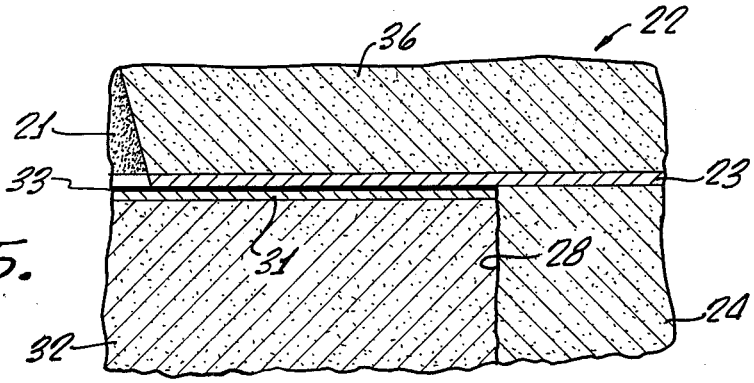
FIG. 5.

CEILING PATCH APPARATUS AND METHOD

BACKGROUND OF THE INVENTION

1. Field of the Invention

This invention relates to the field of acoustical ceilings which have been defaced by the mounting therein of decorative hooks for plants, etc.

2. Description of Prior Art

It has for years been common practice to hang objects, particularly plants but also mobiles, etc., from ceilings. A large proportion of such ceilings are of the acoustical variety, comprising a horizontal sheet of wallboard having particulate acoustical material applied by spraying to the bottom surface thereof.

As an example, an apartment complex having numerous tenants frequently has a relatively high rate of turnover. Each time an apartment is vacated, a maintenance crew goes in and tries to make the apartment clean and new-appearing for a subsequent tenant. The apartment is readily cleaned and/or painted, but what to do about the holes in the acoustical ceilings? Many apartment dwellers (and home owners) perforate their acoustical ceilings with decorative hooks, and each hook leaves not only an unsightly hole but also a surrounding region where the acoustical material is bruised-appearing. The hook should not be left in place because the subsequent tenant will probably not want a hook in the same location. The only effective method at this time is to spray the entire ceiling, after filling the hole with plaster, since a mere local spray of acoustical material produces a large, unsightly "patched-appearing" region which is unsatisfactory. Furthermore, even local spraying of acoustical material is a major operation.

Not only is there a substantial problem after a tenant moves out of an apartment, or after a homeowner moves out of a home, but there are frequently problems even while the same tenant or homeowner remains in the apartment or house. For example, a decorative hook may be inserted and a plant hung thereon, following which the person hanging the plant decides that he wants it in another portion of the room. At the present time his only options are to leave an unused hook in place, which seems strange, or else remove the hook and leave an unsightly scar.

There have long been, in the clothing and plywood arts, patch apparatus and methods for applying precision patches to sheets of plywood and articles of clothing. These, however, have not suggested and do not suggest the present solution to a substantial contemporary problem. There are also patents relative to the wallboard and building arts, but these involve large holes, massive removal of wall portions, etc., and do not suggest the present apparatus and method.

SUMMARY OF THE INVENTION

In accordance with the method, a reaming and centralizing element is inserted into the hole in the acoustical ceiling, and serves as the central shaft or axis for blades which scrape from the undersurface of the wallboard the acoustical ceiling material. The reaming action provides a precision hole or bearing adapted to precisely center the blade elements, so that there will be a clean and substantially perfectly circular recess region surrounding the hole and from which the acoustical material is removed. Such region has a predetermined diameter determined by the size of the blades. An acoustical ceiling patch of such predetermined diameter is then adhesively secured in the thus-provided region, in such manner that the edge of the acoustical material in the patch is closely adjacent the encompassing edge of the remaining acoustical material on the ceiling. Thus, in a manner of seconds or minutes, the ceiling is effectively patched by a patch which is substantially invisible to the average viewer.

In accordance with the aparatus, an inexpensive reaming and scraping tool is provided, having a central reaming and centralizing portion adapted to be centered in and to enlarge the already-formed hole in the acoustical ceiling. The enlarged hole serves as a bearing for blade portions of the tool. These blades, when the entire tool is rotated, scrape the acoustical coating from the undersurface of the wallboard at a precisely-determined circular region centered at the center of the hole. The apparatus not only comprises the described tool, but also a circular patch formed of acoustical material on a suitable backing. The patch has a diameter corresponding to the maximum diameter of the blade portions of the tool, and incorporates adhesive means whereby the patch may be secured to the wallboard surface at the scraped-off region of the wallboard and in close peripheral adjacency to the surrounding acoustical material.

BRIEF DESCRIPTION OF THE DRAWINGS

FIG. 1 is an exploded isometric view illustrating the present tool just after it has reamed a hole in the wallboard and after it has formed a circular recess adapted to receive a patch;

FIG. 2 is a side elevational view of the tool;

FIG. 3 is an isometric view of the patch which is adapted to fill the recess shown in the upper portion of FIG. 1;

FIG. 4 is an isometric view illustrating the patched ceiling;

FIG. 5 is a greatly enlarged fragmentary vertical sectional view taken on line 5—5 of FIG. 4; and FIG. 6 is a view of the patch kit.

DETAILED DESCRIPTION OF THE PREFERRED EMBODIMENT

A conventional decorative ceiling hook for plants, etc., incorporates a screw-thread element which—when removed—leaves a relatively large, unsightly hole (and sometimes also leaves a surrounding bruised region in the acoustical ceiling material). The hole (not shown, except after reaming) is termed "relative large" since it is much larger than a nail hole. It is, however, actually "small" in comparison to (for example) a caved-in region of wallboard.

The present tool, which is designated generally at 10 in FIGS. 1 and 2, incorporates at its center (axis) a reaming and centralizing element 11 having an upper end 12 (when the tool is oriented in position for use) and a lower end 13.

The diameter of the upper tool end 12 is sufficiently small that such end may be inserted into the already-formed hole created by the screw thread of a conventional decorative plant hanger. Conversely, the lower end 13 is caused to be sufficiently large that such lower end is larger in diameter than is the hole formed by the screw thread of a conventional decorative plant hanger. Thus, upper end 12 may be readily inserted into the hanger-formed hole (not shown), but in most cases the lower end 13 may not be introduced into such already-formed hole until the tool is rotated to create the reaming action described below.

In order that reaming may be achieved effectively, the reaming and centralizing element 12 comprises a plurality of blades 14 (illustrated as five in number) which are preferably equally angularly spaced relative to each other. Each of the blades 14 inclines upwardly and inwardly, that is to say that the outer portions of the various blades 14 converge upwardly. The blades 14 need not have sharp edges since the gypsum within the wallboard is readily abraded away even by rounded outer blade surfaces such as those illustrated. The paper at the bottom side of the wallboard need not be cut but can instead be pushed up into the hole and still provide a proper centralizing operation relative to the scraper portions described below.

Exending radially-outwardly from the lower end of each of the reaming and centralizing blades 14 is a scraping blade 16. Thus, in the illustrated embodiment there are five such scraping blades 16 and each has the same length. The scraping blades, and also the blades 14 which make up element 11, are mounted on a disc-shaped body 17 which is circular in shape and is centered at the axis of element 11. Preferably, body 17 has an outer cylindrical surface 18 which is flush with the extreme outer ends of blades 16.

The upper edges of scraping blades 16, like the outer edges of reaming blades 14, are rounded. Thus, the scraping blades do not cut into the paper at the bottom side of the wallboard. The outer ends of the scraping blades 16 are also rounded.

A handle 19 is provided diametrally on the lower side of the disc-shaped body 17 and is readily grasped by the user. Thus, all the user need do is grasp the handle, move the tool 10 upwardly until the upper end 12 of element 11 is inserted into the previously-made rough hole formed by the plant hanger, and then rotate the tool about its axis in either direction. Simultaneously, the tool is pressed upwardly. Thus, the element 11 penetrates the rough hole and reams it out to form a larger hole such as is illustrated at 21 in FIGS. 1 and 5. At least the lower portion of such larger hole 21 has a diameter substantially equal to the diameter of the circular junction region between reaming blades 14 and scraping blades 16.

Because of the described reaming operation, the hole 21 and the element 11 cooperate effectively with each other to perform a precise centralizing operation which causes the outer ends of blades 16 to move in a circular path. Effective centralizing is also achieved even before completion of reaming, the element 11 being centered effectively prior to the time that the upper edges of scraping blades 16 first engage the lower surface of the acoustical ceiling material.

Reaming and centralizing are continued until all of the acoustical material is scraped off the wallboard within a circular recess 27 corresponding to the outer diameter of body 17 (that is to say, to the diameter of the path of motion of the extreme outer ends of scraping blades 16). It is pointed out that the elevations of the scraping blades 16 above disc 17 are normally at least equal to the thickness of the acoustical material, so that the body 17 itself normally need not penetrate into the recess in the acoustical material.

There is, accordingly, provided a sheet 22 of wallboard comprising gypsum 36 confined between two layers of paper adhesively secured thereto, the lower paper layer of the wallboard being indicated at 23 in FIGS. 1 and 5. Adhesively secured (by spraying) to the lower surface of paper 23 is a layer 24 of conventional acoustical ceiling material. (Thus, paper 23 may be termed the "substrate".) Such ceiling material may be, as one example, the type described in U.S. Pat. No. 3,338,848, which patent is hereby incorporated by reference herein as though set forth in full.

A circular region of the ceiling material is scraped off, by the scraping blades 16 as described above, to form a relatively large diameter circular recess indicated at 27. The recess is defined peripherally by a wall 28 of acoustical material, the wall 28 having been formed by the actions of the extreme outer ends of blades 16. The wall 28 is coaxial with the reamed-out hole 21, again because of the conjoint operation of the elements 11 and 16 as above described.

It is then merely necessary for the operator to place in the recess 27 a patch 29 of corresponding size and shape, and which is constructed as next described. The patch comprises a disc 31 of thin backing paper or other suitable material, such disc having a diameter only very slightly smaller than that of the above-indicated peripheral wall 28. To the underside of disc 31 is applied a coating 32 of acoustical material.

Preferably, a sheet of the paper or other material forming disc 31 is first sprayed with acoustical material, following which the acoustical material is allowed to dry. Then, the combination is die cut to provide the combination of the disc 31 and the disc-shaped acoustical coating 32 which is coaxial and coextensive with the disc. The coating 32 may, for example, be formed of the same material described in the above-cited patent.

The upper surface of disc 31 is coated with a suitable adhesive, preferably a pressure-sensitive adhesive represented at 33 in FIGS. 3 and 5. As shown in FIG. 3, there are two semicircular release sheets applied to the adhesive 33 during shipment and storage thereof, and which are readily removed by the user immediately prior to application of the patch into recess 27. Thus, the release sheets 34 are first peeled off, following which the disc 31 and coating 32 are pressed upwardly into recess 27 and upward pressure is applied.

The thickness of the coating 32 is caused to correspond to the conventional thickness of coatings of acoustical ceiling material in dwellings. Thus, the lower surface of the patch, and the lower surface of the remaining ceiling material 24, are substantially flush with each other as indicated in FIGS. 4 and 5.

Referring to FIG. 5, the gypsum is represented at 36, a portion of the reamed-out hole 21 is represented at the far left, and the wallboard layer 23, adhesive 33 and patch backing disc 31 are shown in sandwich relationship. The disc-shaped ceiling material (disc) 32 is shown as seated snugly in the recess, with the peripheral surface of the acoustical ceiling patch material being adjacent the above-indicated peripheral wall 28. Instead of being cylindrical as shown, these peripheral walls may be frustoconical and upwardly convergent.

The patch 29 (FIG. 3) and the tool 10 (FIGS. 1 and 2) are sold in a kit, for example in a plastic bag. Several of the patches are sold along with the tool. Preferably, such kit is sold in the same portion of stores wherein ceiling plant hooks are sold, so that customers may buy hooks and patch kits at the same time.

Referring to FIG. 6, the completed kit is illustrated as comprising a transparent plastic bag 40 having a cardboard display header 41. The tool 10 and the corresponding patch 29 are contained within the bag 40, more than one of the patches 29 being conventionally provided as indicated above.

Much less preferably, the patch may be formed of adhesive-backed plastic which only simulates acoustical material.

The foregoing detailed description is to be clearly understood as given by way of illustration and example only, the spirit and scope of this invention being limited solely by the appended claims.

I claim:

1. A patching tool for preparing an acoustical ceiling having a hole therein to receive an acoustical patch, said tool comprising:

a circular disc of synthetic resin:

a plurality of scraping blades extending radially along one side of said circular disc, said scraping blades comprising ridges of synthetic resin fixedly attached to said circular disc along their radial extension therewith, the outermost edges of said scraping blade ridges scribing a circle equivalent in diameter to the patch to be used for the ceiling;

a plurality of centering ridges disposed about a vertical axis of rotation of said circular disc fixedly attached to and extending upwardly from the scraping blade ridges for insertion into the hole in said acoustical ceiling and guiding the rotational movement of said scraping blade ridges; and a handle fixedly attached to the disc on the side opposite said scraping blades along a diameter line thereof for permitting the user to rotate said patching tool around its vertical axis and thereby scrape away a portion of the acoustical ceiling to receive the acoustical patch in a mating relationship.

2. The invention as claimed in claim 1, in which said centering ridges are upwardly tapered whereby the upper end is much smaller in diameter than the lower end.

3. The invention as claimed in claim 1, in which the circular disc, centering ridges, scraping blade ridges and handle are integrally formed of synthetic resin.

4. The invention as claimed in claim 1 wherein there is a one-to-one correspondence between the scraping blade ridges or said centering ridges, said centering ridges extending upwardly from their respective scraping blade ridges.

5. The invention as claimed in claim 4 wherein there are 5 scraping blade ridges and 5 centering ridges.

6. The invention as claimed in claim 5 wherein said centering ridges are upwardly tapered whereby the upper end is much smaller in diameter than the lower end.

7. The invention as claimed in claim 4 wherein the scraping blade ridges and centering ridges have rounded edges.

* * * * *